United States Patent [19]

Stover

[11] 4,288,759

[45] Sep. 8, 1981

[54] MICROWAVE TRANSFORMER

[76] Inventor: Harry L. Stover, 99 E. Middle Field Rd., Mountain View, Calif. 94043

[21] Appl. No.: 116,121

[22] Filed: Jan. 28, 1980

[51] Int. Cl.[3] ..... H01P 5/00

[52] U.S. Cl. ..... 333/24 R; 333/246; 333/263; 330/286

[58] Field of Search ..... 333/24, 33, 238, 246, 333/262, 263, 104, 26; 336/200, 232

[56] References Cited

U.S. PATENT DOCUMENTS

| | | | |
|---|---|---|---|
| 2,611,822 | 9/1952 | Bliss | 333/246 X |
| 2,936,417 | 5/1960 | Hedberg | 333/24 R X |
| 3,283,267 | 11/1966 | Urmoneit | 333/24 R |
| 3,428,886 | 2/1969 | Kawashima et al. | 333/33 |
| 3,737,815 | 6/1973 | Low et al. | 333/238 X |
| 4,023,125 | 5/1977 | Wolfe | 333/238 |

*Primary Examiner*—Paul L. Gensler
*Attorney, Agent, or Firm*—Joseph E. Szabo; W. H. MacAllister

[57] ABSTRACT

Transformer configurations especially useful in the microwave frequency range. A reliable physical center-tap is achieved by the interposition of a stub at the center of an elongated member which provides electrical contact with a reactive impedance. The circuit formed thereby allows the reflection of an r.f. short circuit to the center of the elongated portion without attendant fabrication thereon. A loop configuration for the remaining coupling means allows adjustability of electromagnetic coupling which is less sensitive to spacing of primary and secondary than the common parallel configuration.

10 Claims, 8 Drawing Figures

Fig. 2.
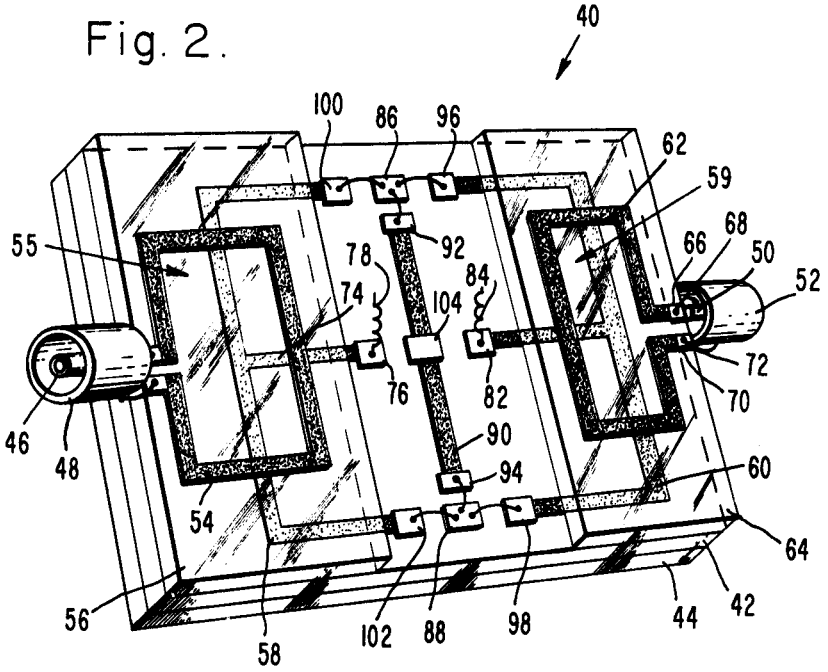
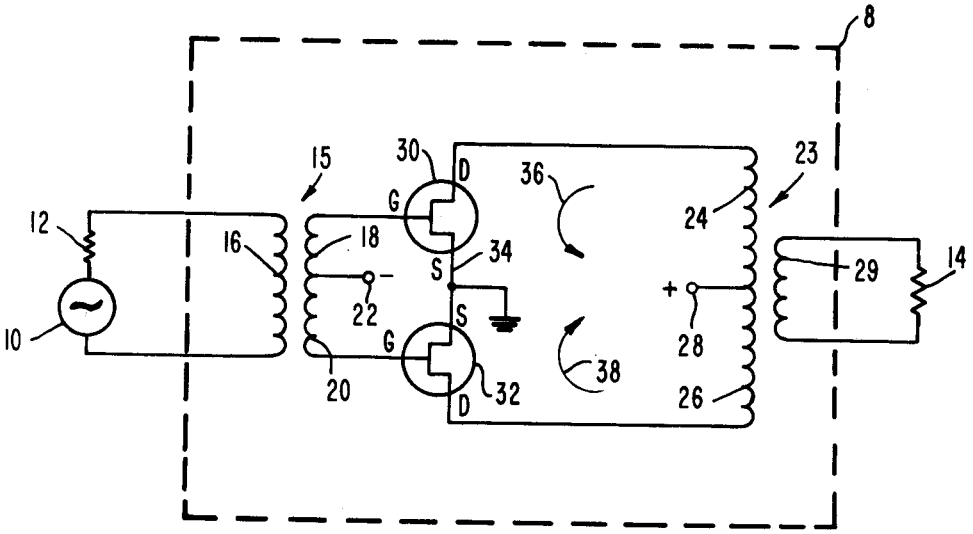
Fig. 1.

Fig. 3a.
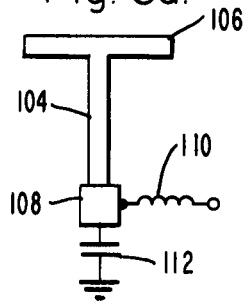
Fig. 3b.
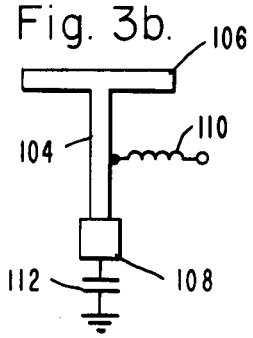
Fig. 3c.
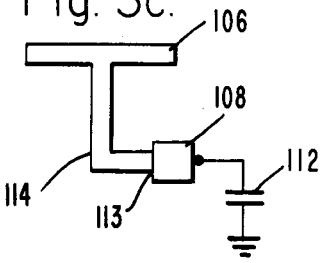
Fig. 3d.
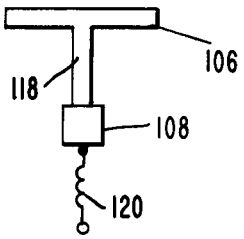
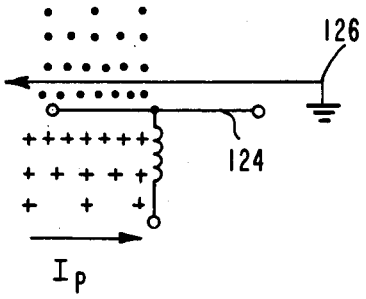
Fig. 4a.
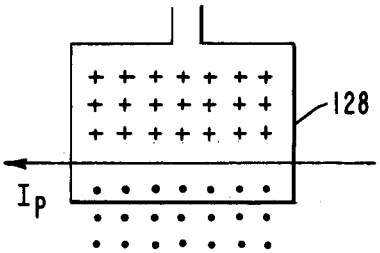
Fig. 4b.

MICROWAVE TRANSFORMER

CROSS-REFERENCE TO RELATED APPLICATION

The subject matter of this application is related to the pending United States patent application of Harry L. Stover and George R. Brewer (Ser. No. 118,059, filed Feb. 4, 1980) entitled "Microwave Power Amplifier". This application is the property of the assignee herein.

TECHNICAL FIELD

The present invention relates to means for facilitating power combination at microwave frequencies, and, more particularly, to improved transformer means for combining the power output of two power transistors in push-pull operation at microwave frequencies.

BACKGROUND ART

It is widely accepted that there are at least three significant levels of high frequency power combining. At a first level, increased power output can be obtained through the combination of several devices on a single chip carrier (packages, pins, headers or the like). At this level, distances are maintained small with respect to a quarter wavelength so that the composite device acts as a single device electrically. At an intermediate level, modulator circuitry may be employed wherein several devices are summed by circuit means that determines their performance (such as a push-pull amplifier) prior to the delivery of their output to a transmission line for further combination in a totally different form of circuit. Finally, gross or large-scale power combining involves a multiplicity of devices, transmission lines or antennae summed in a manner which does not discretely limit the number of devices. The first of the aforementioned levels has received considerable effort and innovation over the years, including series and/or parallel power combining of devices on diamond heat sinks and metal headers. At the gross level, considerable effort and support has produced some innovation. For example, a large-scale power-combining device is disclosed in U.S. Pat. No. 3,931,587, issued to Robert S. Harp and Harry L. Stover, entitled "Microwave Power Accumulator". This patent is the property of the assignee herein.

The second of the aforementioned levels, the modular level of power combining, has not yet received significant attention. By definition, the modular level infers a class of amplifiers/oscillators that requires more than one device to function properly in a given, desirable mode. Push-pull amplifiers and balanced amplifiers are examples of this class of combiner; the performance of the system or module is unlike the performance of a single device in some desirable respect.

Push-pull power amplifier/combiners, in which the power outputs of two separate devices (e.g., FETs, bipolar transistors, IMPATT or GUNN diodes) are in some way combined to produce the output transformer primary current, may be classified according to their mode of power combination. In a class-A amplifier/-combiner, the two devices, simultaneously "on", are run out of phase, producing a standing wave across the primary which oscillates about a center null point. Contrariwise, in class-B operation, the power devices are switched on and off alternately to deliver a full-wave rectified pulsating current to the center of the primary. Significant operational advantages (in terms of r.f. power output, d.c. to r.f. efficiency, and transistor junction temperature) are achieved by class-B operation as a result of the fact that twice the current swing (and, consequently, four times the instantaneous power) can be achieved in class-B operation for a given FET (or equivalent device) power swing. When no input signal is present in the class-A amplifier, the maximum d.c. power is dissipated and, at maximum output r.f. voltage swing, at most half of the d.c. power is converted to a.c. Conversely, when no input signal is present in a class-B amplifier, no current flows and, hence, no power is dissipated. This feature is very significant when the dynamic range of the amplifier/combiner is an important system consideration.

Consistent with the foregoing, it can be shown in theory that class-B operation delivers twice the r.f. power of class-A operation and at a higher efficiency. Device junction temperature rise in class-B is lessened by a factor of $1 \div 1.83$ despite the generation of twice the r.f. power. Thus, class-B push-pull operation is eminently more suited for power combining applications than class-A single-ended or class-A push-pull. A large-scale combiner incorporating class-B modules would require half an many power modules for a specified peak power. Likewise, for a large scale combiner operating at thermal limits, approximately one fourth as many modules are required. Additionally, prime power requirements are reduced in either application (due to the improved d.c. to r.f. conversion).

Although the advantages of the class-B power amplifier are well known and have been commonly achieved at lower frequencies, class-B operation at microwave frequencies has been severely hampered by the distortion encountered at gigahertz-range frequencies resulting from crosstalk between the active devices. This cross-talk is a result of imperfections in achieving a true voltage null at the center of the primary. The sensitivity of class-B operation results in part from the continual switching of the two power devices at gigahertz-range frequencies. Fabrication of a transformer primary for gigahertz-range frequencies with a reliable center tap has been extremely difficult to achieve and has led to alternative approaches including the less-desirable class-A mode and the use of 3 db couplers and the like. An additional difficulty at high frequencies results from the extreme sensitivity of inductive coupling to primary-secondary spacing. Such sensitivity limits the ability to vary the mutual coupling to adjust power device loading for higher power and efficiency. The ability to make such an adjustment increases the efficiency of the module; a slight misadjustment in the coupling can cause efficiency to degrade, resulting in greater power dissipation in the transistor and, often, device burnout.

SUMMARY OF THE INVENTION

It is therefore an object of the present invention to produce a transformer which facilitates class-B power amplifier at microwave frequencies.

Another object of the present invention is to produce a transformer which facilitates class-B push-pull power amplification whereby the power amplifier is not subject to performance degradation by crosstalk between its constituent active devices.

A further object of the present invention is to devise an improved center-tapped microwave transformer which achieves the objects hereinabove and which can be satisfactorily fabricated by present-day techniques.

Still a further object of the present invention is to achieve a microwave transformer having improved coupling characteristics, including a variable coupling capacity.

These and other objects are obtained by the present invention which provides an improved high frequency transformer. The transformer features a center-tapped geometry. Although a number of specific center-taps are disclosed herein, a unifying feature is the inclusion of quarter and one-half wavelength stubs to remove potentially deleterious fabrication effects (which might otherwise affect the physical center tap) from the critical center tap portion of the coupling element of the transformer. An additional feature of the improved microwave transformer is the loop geometry of the non-tapped transformer element. The loop configuration allows the adjustable and reliable coupling of primary and secondary and makes such coupling less critically dependent upon the spacing thereof.

Other and further aspects of the present invention will become apparent during the course of the following description and by reference to the accompanying drawings.

BRIEF DESCRIPTION OF THE DRAWINGS

Referring now to the drawings, in which like numerals represent like parts throughout:

FIG. 1 is an electrical circuit schematic view of a class-B push-pull power amplifier in the grounded-source FET configuration;

FIG. 2 is a perspective view of a high frequency power amplifier module incorporating transformers according to the present invention;

FIGS. 3*a* through 3*d* display alternative center-tap configurations for a microwave transformer within the scope of the present invention; and FIGS. 4*a* and 4*b* are electrical schematic views of transformers according to the prior art and to the present invention, respectively, principally for the purpose of aiding theoretical discussion of the loop configuration incorporated in the present invention.

DETAILED DESCRIPTION OF THE INVENTION

In FIG. 1 there is presented an electrical circuit schematic illustrating the general theory of the class-B push-pull power amplifier. The resulting advantages of the class-B mode of operation have already been discussed and the schematic of FIG. 1 is presented primarily to provide a frequent reference whereby the high frequency or microwave version thereof, including the inventive transformers described in detail infra, will be readily appreciated.

The general class-B amplifier includes the various elements within the dashed border 8. Signal energy represented by the a.c. source 10, having r.m.s. power represented by the passage of current through the resistance element 12, is applied to the amplifier 8 to yield an amplified power output represented by the passage of output current through the load resistance 14. Within the amplifier 8, signal energy is applied to an input transformer 15 including a primary coil 16 and a center-tapped secondary having equal-turn coupling segments 18, 20 and center-tap 22. A "mirror image" output transformer 23 having equal-turn primary coupling segments 24, 26 and center-tap 28 is inductively coupled to a secondary coil 29 which lies in an output circuit including the load resistance element 14. Power amplification is achieved by means of the "push-pull" driving of the active devices 30, 32 (shown in FIG. 1 as field effect transistors in a grounded-source configuration). Thus, the conductor 34 is at ground potential and the control gates of the transistors are engaged to opposite ends of the center-tapped secondary of the input transformer 15. Other active devices and configurations might be equivalently applied to the circuit of FIG. 1 for class-B push-pull operation.

In operation, the advantageous push-pull characteristics of the amplifier 8 is achieved by the alternating application of activating voltage to (i.e., switching "on") the control gates of the switching FET's 30, 32 throughout the sinusoidal cycle of the alternating current applied by the a.c. source 10. That is, when the current flow in the loop which includes the a.c. source 10 is clockwise, a back e.m.f. is generated in the secondary of the input transformer 15 causing current to flow from the gate of FET 32 through the coupling section 20 of the secondary to the (negative potential) center-tap 22. The induced back e.m.f. thereby raises the gate of the FET 32 to a positive potential which, assuming an N-channel device, turns the FET 32 "on". Conversely, during the portion of the cycle that current flows counter-clockwise in the same loop, current flow is induced in the secondary from the gate of the FET 30 through the coupling segment 18 to the center-tap 22, causing the potential of the gate of the FET 30 to rise to some positive value. Once again, assuming the device is N-channel, the FET 30 is then turned "on". Thus, a pulsating, positive-going (as opposed to the continuously varying sinusoidal current of a.c. source 10) current is delivered to the center-tap 22 from alternating portions of the input center-tapped secondary.

The FETs 30, 32 are turned "on" alternately by the clockwise (FET 32) and counterclockwise (FET 30) cycles of the sinusoidally-varying current flow in the loop of the a.c. source 10 and input primary 16. This, in turn, results in a clockwise flow of alternating current from the center tap 28 of the primary of the output transformer 23. Clockwise current flow within the loop 38 will occur when the FET 32 is "on" while counterclockwise cycles (indicated by the loop 36) result when the FET 30 is "on". The alternating current flow originating at the center tap 28 will be a multiple of the current applied to the amplifier 8 from the a.c. source 10 due to the current gain, a function of the transconductance, of the FET devices. When this increased current flow is inductively coupled to the secondary 29 of the output transformer 23, increased current and resultant power amplification is achieved by the power amplifier 8.

The various benefits of the above-described mode of power amplification have been found to be difficult to achieve in the microwave frequency range. Attempts to construct a high frequency analogue of the low frequency amplifier 8 have encountered grave difficulties which may be traced in part to the comparability of microwavelengths to circuit dimensions. In particular, the necessity of providing physical center taps 22, 28 on the input and output transformers so that the FET's 30, 32, driven in-phase, achieve a realiable r.f. voltage null at the center tap has hindered development. A difficulty in fabrication of such a device is presented by the relatively large size of the electrical contact (in relation to wavelength) required. A small error in the placement of the tap will result in undesirable "crosstalk" between the FET's, introducing undesired harmonics into the output of the amplifier 8. That is, the voltage on the output of one FET will now be isolated from the other FET, thereby causing unwanted currents to flow in the other FET.

FIG. 2 is a perspective view of a class-B microwave power amplifier module 40 incorporating transformers according to the present invention. The microstrip module 40, is formed upon an electrically insulative substrate 42. The substrate 42 may be formed of a number of suitable materials well known in the art including, but not limited to alumina, fused silica (quartz), sapphire and the like selected for manufacturability, heat dissipation, low-loss to r.f. and allied properties which will become apparent from the discussion. The insulative substrate 42 is seated upon a metal ground plane 44. Once again, a number of materials generally within the class of metallic electrical conductors will suffice.

Incoming electromagnetic energy enters the module 40 by means of a coaxial cable having an inner probe 46 suspended within an r.f. grounded casing 48 (Alternatively, dielectric material may insulate the probe 46 from the casing 48). Similarly, the output of the module 40 is applied to an output coaxial cable having a probe 50 suspended within the r.p. grounded casing 52. Although TEM inputs and outputs are envisioned by the usage of coaxial input and output means, equivalent modes of transfer of electromagnetic energy may be utilized including, but not limited to, the maintenance of the quasi-TEM mode of the microstrip input and output transformers, discussed infra. Such a transmission mode might be quite advantageous if, for instance, it is desired to aggregate a number of identical modules.

Electromagnetic energy entering the module 40 is coupled to the microstrip primary loop 54 of an input transformer 55 according to the present invention. The primary loop 54 is situated upon a dielectric layer 56 which provides insulation between the primary 54 and the underlying center-tapped microstrip secondary 58 that completes the input transformer 55. Suitable dielectric materials for the layer 56 include, but are not limited to polymide, mylar, kapton, sputtered $SiO_2$, nitride and the like. This transformer arrangement is mirrored by a microstrip output transformer 59 consisting of the center-tapped primary 60 which underlies the secondary loop 62. Again, primary and secondary are insulated by an intervening dielectric layer 64. Alternatively, an insulating air gap may replace the dielectric layers 56 and 64. The transformer-to-cable transition is accomplished in FIG. 2 (output transformer) by means of the conductive engagement of one end of the secondary loop 62 (through the impedance matching network 66 and the wire 68) to the (alternating potential) inner probe 50 while the other end of the secondary loop 62 is connected (via the impedance matching network 70 and the wire 72) to the (r.f. grounded) casing 52. A similar arrangement is utilized to couple the input primary 54 to the input coaxial cable. The coax-to-microstrip transition may be aided by the incorporation of an appropriate launcher or transducer such as is presently commercially available from the Omni Spectra Company of Phoenix, Ariz. and from Microtech of New Jersey.

As can be observed from FIG. 2, both the input transformer secondary 58 and the output transformer primary 60 feature physical center taps. A number of such geometries are included within the scope of the present invention and are illustrated in FIGS. 3*a* through 3*d*. The center tap construction of FIG. 2 utilizes a one-half wavelength microstrip stub 74 (input secondary) which is terminated at the impedance contact pad 76 which, when connected to the impedance network components described below, approximates an r.f. short circuit. Coil 78, which, it will be seen, serves as a power supply contact, is engaged thereto. A capacitor chip (not shown in FIG. 2) is connected to the bottom of the pad 76 and, through a hole in the substrate 42, to the ground plane 44. The primary of the output transformer is, as mentioned above, identical to the secondary of the input transformer and thus features a one-half wavelength microstrip stub connecting the center tap to an impedance contact pad 82 to which the coil 84 (and an unseen capacitor chip) is affixed. The geometry of the center-tapped output primary and of the input secondary of the module 40 provides a reliable physical r.f. voltage null by minimizing the amount of mechanical fabrication at the center tap (e.g. welding, drilling the substrate 42 beneath the center tap).

Chip-like semiconductor field effect transistors 86,88 which, when driven, provide the power amplification of the module 40, are conductively engaged to opposite ends of the center-tapped input transformer secondary and output transformer primary. Gate connections are effected by means of the impedance matching networks 100, 102 and associated wire conductors while drain connections involve the impedance matching networks 96, 98 and associated wire conductors. Source connections are made to the microstrip line 90 through the impedance matching networks 92, 94. The sources are grounded to the plane 44 by means of a wire (not shown) establishing contact between the plane 44 and the conductive contact pad 104.

The module 40 of FIG. 2 operates at microwave frequencies according to class-B push-pull theory. The critical inventive center-tapped transformers of the module 40 enable the module to achieve efficient power amplification at microwave frequencies without FET crosstalk and/or the introduction of undesired harmonics into the output. A module 40 as disclosed in FIG. 2 can be used alone; alternatively, the power from many such modules may be summed in a large-scale power combiner. Additionally, the simple configuration of the module 40 allows the volume manufacture thereof in a number of transmission media in addition to microstrip. Balanced coax, inter alia, allows like fabrication operable through X-band.

The realization of the module 40 of FIG. 2 is critically dependent upon the existence of a reliable physical null at the center of the secondary of the input transformer and at the center of the primary of the output transformer. As mentioned above, the high operating frequencies of the device (such a module is likely to prove most advantageous in various frequency bands ranging from 2 GHz to 12 GHz) impose great difficulties in achieving a workable center-tapped transformer. FIGS. 3*a* through 3*d* display various center-tapped geometries, including that of the input and output transformers of the module 40 of FIG. 2, which achieve improved performance generally by the interposition of an impedance-transferring/ inverting stub connecting the center tap with various circuit fabrications. The use of an appropriately dimensioned stub allows the removal of fabrications such as welds, holes through the substrate 42, low loss conductor-to-weld parisitics and the like from the critical center-tap area. Although the sizing of the stub will be somewhat bandwidth-limiting, the reliable physical null thereby achieved provides substantial benefits as mentioned.

FIG. 3*a* presents the center-tap geometry of the transformers of the module 40 illustrated in FIG. 2. As mentioned above, a one-half wavelength stub 104 joins the (primary or secondary) coupling element 106 to an impedance contact pad 108 which serves as the point of electrical contact for a coil 110 and a capacitor chip 112. The coil (r.f. choke) 110 prevents dissipation of the r.f. energy in the low-impedance d.c. power supply. The capacitor chip 112, positioned between the end of the one-half wavelength stub 104 and the ground plane 44, reduces the r.f. distortion in class-B operation which results from the full-wave rectified pulsating current delivered to the center-tap (discussed above). The center-tap geometry illustrated in FIG. 3*a* allows the placement of the MOS capacitor chip in such position that no substrate hole is required in the vicinity of the center-tap, rendering unnecessary the interruption of the low loss metallization of the coupling member 106 and the accompanying introduction of undesired parasitics. The r.f. short circuit at the end of the stub 104 reflects a short circuit one-half wavelength away at the primary center-tap, while the d.c. component of the pulsating current, having been smoothed by the reflected capacitive impedance, is pulled through the inductance of the coil 110.

An alternative center-tap scheme appropriate for class-B operation is illustrated in FIG. 3*b*. Once again the grounded capacitor 112 is engaged to the end of the one-half wavelength stub 104. The coil 110 is connected to the mid-length of the stub 104, one-quarter wavelength from the primary center-tap. Both impedances are reflected at the center-tap as r.f. short circuits and, once again, the d.c. component, smoothed by the reflected capacitance 112, is pulled through the dc bias circuit.

The capacitor chip which serves as an r.f. short need not be connected through a hole in the substrate 42. The substrate can be so configured that the end of the stub coincides with and/or overlies the edge of the substrate 42 allowing the capacitor to be mounted or soldered directly to the ground plane 44, a ground pedestal (in the case of balanced coax fabrication) or ground bus (stripline fabrication).

Another alternative is illustrated in FIG. 3*c*. The one-half wavelength stub of FIG. 3*c* is folded to save space and/or to connect to the side of an appropriately configured circuit module. The coil or r.f. choke may be connected to a bias voltage supply at the point 113 or 114 to achieve the operational equivalent of the center tap shown in FIG. 3*a*.

In FIG. 3*d* a center-tap is illustrated which is most appropriate for a class-A push-pull amplifier/oscillator operation. Unlike the class-B center-tap configurations discussed above, no provision is made in FIG. 3*d* for the inclusion of a capacitor chip. This is due to the fact that, in class-A, the two FETs operate 180° out-of-phase to achieve a voltage null. The center of the primary (or secondary) should therefore have a dc average value of zero volts. Thus, no capacitive element need be incorporated into the transformer for the smoothing of an average dc level. The physical center-tap shown in FIG. 3*d*, therefore, incorporates a degree of redundancy into a class-A push-pull amplifier, constraining the two transistors (or equivalent active devices) to operate 180° out-of-phase instead of relying entirely on out-of-phase operation of the devices to achieve the desired voltage null. Effects of minor phase differences in signal paths, feedback paths or phase jitter are greatly reduced for coherent signals. The stub 118 is one-quarter wavelength (at the midband frequency of operation), connecting an r.f. choke 120 (associated with the bias supply) to the coupling element 106. The quarter wavelength center stub 118, as is well known in the microwave art, acts as an impedance inverter. Thus, the impedance of the r.f. choke 120 is reflected to the center of the coupling element 106 as a short circuit. As mentioned above, the transistors, operating out of phase (class-A), simultaneously cause a voltage null at this point. The net effect of these superimposed phenomena is to "improve" the null, improving the effective Q, (by reflective feedback) of the device/circuit in the coupling arm 106, to effect the above-mentioned reduction of phase jitter and other forms of distortion caused by path differences in the push-pull circuits. All of the center-tapped configurations illustrated in FIGS. 3*a* through 3*d* are very easy to manufacture in a number of media and particularly in microstrip. Various fabrications illustrated above employ low-resistance solder for some metal (silver) parts, gold-tin preformed solder for microstrip and device chip and gold bonding wire for device, chip and capacitor interconnections. The stub 118 may act as a bandwidth limiting element, but it need not be severely limiting as semiconductor power device characteristics are much more likely to dominate the bandwidth of the module 40.

An additional feature of the improved transformer of the present invention, improved reliability and adjustability of coupling, arises from the "loop" geometries of the primary of the input transformer and the secondary of the output transformer utilized in the module 40 of FIG. 2. Referring to FIGS. 4*a* and 4*b*, a comparison may be made between the transformer of the prior art, which features a parallel secondary and primary, and the present invention. In FIG. 4*a*, current $I_p$ flowing in one-half of the center-tapped primary 124 has associated therewith magnetic field lines forming concentric circles. Each of the concentric field lines is indicated by a "cross" (field direction into the paper) coupled with a dot (field out of the paper) an equal distance on the opposite side the primary 124. It will be noted that the density of field lines diminishes as the distance from the primary center line increases. The direction and intensity of the lines cut by the secondary 126 determine the induced current flowing therethrough. Since all of the lines cut by the secondary 126 of FIG. 4*a* point in the same direction, a small movement of the secondary 126, which is closely spaced to the primary 124, will result in a rapid change in $I_s$, the current flow induced in the secondary. It is therefore clear that this transformer coupling is critically dependent upon spacing between primary and secondary and, if variable, would involve a non-trivial adjustment in many circuit applications. Small manufacturing imperfections are therefore likely to have a significant impact upon the performance of a transformer having primary and secondary configured according to the prior art illustrated in FIG. 4*a*. High power amplifier/oscillators, and particularly experimental amplifier/oscillators, require a non-critical adjustment on the transistor loading to alter the transformer coupling continuously for higher power and high efficiency.

In contrast, FIG. 4*b* illustrates schematically the rectangular loop of the present invention forming the transformer secondary overlying a straight line primary. The illustration of FIG. 4*b* is in accordance with the looped input primary and output secondary of the module 40 of FIG. 2. The secondary 128 encloses field lines pointing both into the paper and out of the paper. It is the difference between the magnetic flux pointing in one direction and that pointing in the other direction (net flux) which determines the direction of current flow in the secondary. If the loop were to enclose exactly as many magnetic field lines pointing into as out of the paper, the current in the secondary would be zero. If the secondary is moved from the "null" position (equal and opposite flux), an increase of net current through the loop occurs with a relatively noncritical dependence upon the distance moved. This occurs as the magnetic field lines being added and subtracted are relatively far from the center line of the primary and, hence, do not exhibit the large changes which would occur for small changes in two closely spaced lines. This feature accounts for the improved adjustability of coupling and the concurrent relative insensitivity of the transformers of the module 40 to unavoidable fabrication tolerance limitations.

Thus, it is seen that there has been brought to the microwave art a center-tapped transformer having improved high frequency performance characteristics. Utilizing transformers according to the present invention one may realize, inter alia, improved power combining by employing the class-B mode thereof. Such mode requires transformers having a reliable physical center tapped voltage null.

Transformers according to the present invention are amenable to manufacture in microstrip and other microwave transmission media by present-day manufacturing technologies. The interposition of a stub member between the major portion of the center-tapped element and circuit fabrications allows for non-critical manufacturing tolerances. Additionally, the transformer of the present invention achieves improved variable coupling characteristics by means of a loop geometry which reduces the criticality of primary-secondary spacing.

What is claimed is:

1. A center-tapped transformer for transferring energy having a center frequency $1/\lambda$ comprising:

(a) first coupling means including an elongated member and a stub member, said stub member having first and second ends, said first end conductively engaged to the center of said elongated member;

(b) second coupling means comprising a loop overlying and inductively engaged to said first coupling means; and (c) means for providing a reactive impedance conductively engaged to said stub member at a distance of a multiple of one-quarter $\lambda$ from the first end of said stub member.

2. A transformer as defined in claim 1 further characterized in that said means for providing a reactive impedance includes means for isolating direct current from alternating current energy so that a d.c. bias may be provided to said first coupling means.

3. A transformer as defined in claim 2 further characterized in that said means for providing a reactive impedance and said stub member of said first coupling means are so arranged that a short circuit is reflected to the center of said elongated member of said first coupling means with respect to energy of frequency $1/\lambda$.

4. A transformer as defined in claim 3 further characterized in that said stub member includes a right angle bend a distance one-quarter $\lambda$ from said first end.

5. A transformer as defined in claim 4 further characterized in that:

(a) said means for providing a reactive impedance includes an inductor and a grounded capacitor; and (b) said inductor and said grounded capacitor are conductively engaged to said stub a distance of one-half $\lambda$ from said first end.

6. A transformer as defined in claim 4 further characterized in that:

(a) said means for providing a reactive impedance includes an inductor and a grounded capacitor; and (b) said inductor is conductively engaged to said stub member a distance of one-quarter $\lambda$ from said first end and said grounded capacitor is conductively engaged to said stub member a distance of one-half $\lambda$ from said first end.

7. A transformer as defined in claim 1 further characterized in that said first coupling means and said second coupling means are of microstrip fabrication.

8. A center-tapped transformer for transferring energy having a center frequency $1/\lambda$ comprising:

(a) first coupling means including an elongated member and a stub member, said stub member having first and second ends, said first end conductively engaged to the center of said elongated member;

(b) second coupling means inductively engaged to said first coupling means; and (c) means for providing a reactive impedance including an inductor and grounded capacitor conductively engaged to said stub member at a distance of one-half $\lambda$ from the first end of said stub member so that a direct current bias may be provided to said first coupling means.

9. A center-tapped transformer for transferring energy having a center frequency $1/\lambda$ comprising:

(a) first coupling means including an elongated member and a stub member, said stub member having first and second ends, said first end conductively engaged to the center of said elongated member;

(b) second coupling means inductively engaged to said first coupling means; and (c) means for providing a reactive impedance including an inductor conductively engaged to said stub member at a distance of one-quarter $\lambda$ from the first end and a grounded capacitor conductively engaged to said stub member at a distance of one-half $\lambda$ from the first end so that a direct current bias may be provided to said first coupling means and so that an alternating current short circuit for energy of frequency $1/\lambda$ is reflected to the center of said elongated member of said first coupling means.

10. A center-tapped transformer for transferring energy having a center frequency $1/\lambda$ comprising:

(a) first coupling means including an elongated member and a stub member, said stub member having first and second ends, said first end conductively engaged to the center of said elongated member;

(b) second coupling means inductively engaged to said first coupling means; and (c) means for providing a reactive impedance including an inductor conductively engaged to said stub member at a distance of one-quarter $\lambda$ from said first end so that a direct current bias may be provided to said first coupling means.

* * * * *

UNITED STATES PATENT AND TRADEMARK OFFICE

CERTIFICATE OF CORRECTION

PATENT NO. : 4,288,759

DATED : September 8, 1981

INVENTOR(S) : Harry L. Stover

It is certified that error appears in the above-identified patent and that said Letters Patent are hereby corrected as shown below:

On the cover page insert:

[73] Assignee: Hughes Aircraft Company
Culver City, Calif.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*